US006194985B1

(12) United States Patent
Tanaka et al.

(10) Patent No.: US 6,194,985 B1
(45) **Date of Patent: *Feb. 27, 2001**

(54) OXIDE-SUPERCONDUCTING COIL AND A METHOD FOR MANUFACTURING THE SAME

(75) Inventors: Kazuhide Tanaka, Hitachi; Michiya Okada, Mito; Keiji Fukushima, Hitachi, all of (JP)

(73) Assignee: Hitachi, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/736,695

(22) Filed: Oct. 25, 1996

(30) Foreign Application Priority Data

Oct. 30, 1995 (JP) ..... 7-281288

(51) Int. Cl.[7] ..... H01P 5/00
(52) U.S. Cl. ..... 335/216; 174/125.1
(58) Field of Search ..... 335/216, 299–300; 505/919–21, 599, 924, 230–1; 174/125.1

(56) References Cited

U.S. PATENT DOCUMENTS

| | | | | |
|---|---|---|---|---|
| 4,952,554 | * | 8/1990 | Jin et al. | 505/1 |
| 5,138,393 | * | 8/1992 | Okamura et al. | 335/297 |
| 5,369,088 | * | 11/1994 | Mukai et al. | 505/432 |
| 5,462,920 | * | 10/1995 | Mukai et al. | 505/432 |
| 5,504,984 | * | 4/1996 | Yamada et al. | 29/599 |
| 5,625,332 | * | 4/1997 | Kamo et al. | 335/216 |

FOREIGN PATENT DOCUMENTS

| | | |
|---|---|---|
| 0385485 | 9/1990 | (EP) . |
| 0631331 | 12/1994 | (EP) . |
| 0644601 | 3/1995 | (EP) . |
| 395806 | 4/1991 | (JP) . |
| 5211013 | 8/1993 | (JP) . |
| 652731 | 2/1994 | (JP) . |

OTHER PUBLICATIONS

IEEE Transactions of Magentics, vol. 30, No. 4 Part 02, Jul. 1, 1994, pp. 1645–1650, Fujishiro et al Low Thermal Conductive BI–2223 Tapes Sheated With Ag–Au Alloys.

Applied Physics Letters, vol. 65, No. 7, Aug. 15, 1994, pp. 898–900, Tomita et al Generation of 21.5 T By A Superconducting Magnet System using BI2SR2CACU20/Ag Coil AsAn Inert Magnet.

* cited by examiner

*Primary Examiner*—Lincoln Donovan
(74) *Attorney, Agent, or Firm*—Antonelli, Terry, Stout & Kraus, LLP

(57) ABSTRACT

A method for manufacturing an oxide superconducting coil can suppress deterioration of superconducting characteristics caused by a strong electromagnetic force and deformation and a reaction during heat treatment. The oxide superconducting coil is manufactured by a wind-and-react (W&R) method using a metal sheathed oxide superconducting wire material and an insulator, wherein an oxide film formed on a surface of a heat resistant alloy during a heat treatment is used for insulating the coil, and the heat resistant alloy has a sufficient strength to prevent the deformation of the coil generated by the weight of the coil itself during the heat treatment and to endure a strong electromagnetic force. An oxide superconducting coil operable with a coolant, such as liquid nitrogen, liquid helium, and the like, or a refrigerator, can be realized.

16 Claims, 4 Drawing Sheets

OXIDE-SUPERCONDUCTING COIL AND A METHOD FOR MANUFACTURING THE SAME

BACKGROUND OF THE INVENTION

The present invention relates to an oxide-superconducting coil, and especially, to a wind-and-react type coil using a metal sheathed oxide superconducting wire, and a method for manufacturing the same.

As methods for manufacturing an oxide superconducting wire, a powder-in-tube method, wherein superconducting powder, or a precursor of the superconducting powder, is filled in a metallic sheath, such as a silver tube, and the powder filled sheath is manufactured by a processing such as wire drawing, rolling, and other processes, or a dip-coat method, wherein a substrate is dipped into a suspended liquid containing superconducting powder continuously for coating both planes of the substrate with the suspended liquid, have been conventionally utilized. A superconducting coil using the superconducting wire manufactured by any one of the above methods, and manufactured by a wind-and-react (W & R) method, wherein a heat treatment is performed after fabrication of the coil, or a react-and-wind (R & W) method, wherein a heat treatment is performed prior to fabrication of the coil, has been reported to be able to generate a magnetic field of 3–4 T class under a condition of no backup magnetic field (Ookura et al.: Proceedings of The 53rd. 1995 Annual Meeting (Spring time) of the Cryogenic Engineering and Superconductor Society: D2-2 (1995)), and a magnetic field of 1–2 T under a backup magnetic field exceeding 20 T at 4.2 K (N. Tomita et al.: Appl. Phys. Lett., 65 (7), Aug. 15, 1994, p 898–900).

An oxide superconducting coil had problems such that high performance of the oxide superconducting coil estimated from characteristics of its short sample wire element could not be realized practically, on account of a large electromagnetic force under a strong magnetic field, a creep deformation by its own weight occurring during a heat treatment after fabrication of the coil, a thermal reaction of the superconducting core with an insulating material, and the like.

In detail, there were problems such as (1) breakage of the coil by the effect of an electromagnetic force of 40 MPa when the oxide superconducting coil was installed in an external magnetic field of 20 T and an electric current of 200 A was supplied thereto, (2) thermal creep deformation of the coil due to its own weight when a large scale coil was fabricated using the W & R method, and (3) deterioration of the superconductor in characteristics of the critical current density (Jc) caused by a reaction of the superconductor in the wire material core with a ceramic insulator, which was wound together with the superconductor in the wire material core, during heat treatment.

SUMMARY OF THE INVENTION

The present invention has been developed in consideration of the above problems. One of the objects of the present invention is to provide an oxide-superconducting coil in which can be deterioration of the characteristics in critical current density (Jc) by an electromagnetic force under a strong magnetic field can be prevented along with deformation and other reactions generated during heat treatment, and another object is to provide a method of manufacturing a coil having such qualities.

In order to manufacture a high performance oxide-superconducting coil, it is necessary to improve the mechanical strength of the superconducting coil at a temperature at which the coil is used, or which occurs during heat treatment of the coil, and to investigate the insulating material used in manufacturing the oxide-superconducting coil.

After serious investigation in consideration of the problems described above, the inventors of the present invention have developed an oxide-superconducting coil having the following composition.

The method of manufacturing the oxide-superconducting coil according to the present invention is characterized in the use of a heat resistant alloy, whereon an oxide film is previously formed by a heat treatment, as an insulating material when the coil is manufactured by the wind-and-react method, wherein heat treatment is performed after winding an oxide-superconducting powder filled metallic sheath and the insulating material together to form the coil.

Further, the method of manufacturing an oxide-superconducting coil according to the present invention is characterized in that the heat resistant alloy has a sufficient mechanical strength at an elevated temperature for preventing creep deformation by the weight of the coil itself during the heat treatment, and a sufficient mechanical strength to withstand hoop stress by an electromagnetic force after cooling.

Furthermore, the method of manufacturing the oxide-superconducting coil according to the present invention is characterized in that silver or a silver alloy is arranged at an intermediate layer between the oxide-superconducting wire material and the heat resistant alloy of the oxide-superconducting coil, which is manufactured by winding an oxide-superconducting powder filled metallic sheath and an insulating material together.

Furthermore, the method of manufacturing an oxide-superconducting coil according to the present invention is characterized in that the heat resistant alloy used as the insulating material contains at least one of the metals selected from a group consisting of Ni, Cr, Cu, Nb, Mn, Co, Fe, Al, Mo, Ta, W, Be, Ti, and Sn, all of which have a low reactivity with the oxide-superconducting wire material.

Furthermore, the method of manufacturing an oxide-superconducting coil according to the present invention is characterized in that it can be used in a condition under an electromagnetic force exceeding 40 MPa.

Furthermore, the method of manufacturing the oxide-superconducting coil according to the present invention is characterized in that the widths of the oxide-superconducting wire material, the silver or the silver alloy, and the heat resistant alloy, which are wound together, coincide within a range of 5%.

Furthermore, the method of manufacturing an oxide-superconducting coil according to the present invention is characterized in that a heat treatment is performed, wherein a temperature difference between the inner plane and the outer plane of the coil is kept within a range of 2 degrees by providing a heater at the inside of the bobbin of the coil when the oxide-superconducting coil is manufactured by the method comprising the steps of winding the metallic sheathed oxide-superconducting wire material in a pan-cake shape, or a solenoid shape, and subjecting it to heat treatment.

Furthermore, the method of manufacturing an oxide-superconducting coil according to the present invention is characterized in that a heat resistant alloy or an insulating material composed of $Al_2O_3$ as a main component is wound in a spiral shape together after winding a silver tape or a silver alloy tape onto a surface of the metallic sheathed oxide-superconducting flat square shaped wire material, or tape shaped wire material.

Furthermore, the method of manufacturing an oxide-superconducting coil according to the present invention is characterized in winding the heat resistant alloy or an insulating material composed of $Al_2O_3$ as a main component together in a spiral shape after adhering or joining a silver tape or a silver alloy tape onto a surface of the metallic sheathed oxide-superconducting flat square shaped wire material, or tape shaped wire material for forming a body.

Furthermore, the method of manufacturing an oxide-superconducting coil according to the present invention is characterized in that a heat resistant alloy is used as a material for the core of the coil.

The wire material used in manufacturing the oxide-superconducting coil according to the present invention is characterized in that it is manufactured by alloying an oxide-superconducting wire material coated with at least two kinds of different metals to each other by a heat treatment.

When the oxide-superconducting coil according to the present invention is used in a strong magnetic field, forming a complex superconducting magnet with a metallic group superconducting magnet cooled with liquid helium is effective, and characterized in that all the connecting points of oxide-superconducting current leads for supplying current from a power source to the magnet using permanent current switches composed of an oxide-superconducting coil are made superconducting.

As raw compounds for manufacturing the oxide-superconductor, for instance, in a case of a Y—Ba—Cu—O group, yttrium compounds, barium compounds and copper compounds are used. In a case of a Bi—Sr—Ca—Cu—O group, bismuth compounds, strontium compounds, calcium compounds and copper compounds are used, and depending on necessity, lead compounds and barium compounds are also used. In cases of a Tl—Sr—Ca—Cu—O group and a Tl—Ba—Ca—Cu—O group, thallium compounds, strontium compounds, barium compounds, calcium compounds and copper compounds are used, and depending on necessity, bismuth compounds and lead compounds are used. In order to enhance the crystal growth, sometimes, alkali earth metals, such as potassium compounds, are added. Furthermore, in cases using oxide superconductors, such as when a Hg group superconductor and an Ag group superconductor are used, compounds necessary for forming these superconductor are used. The above various raw compounds are used in forms of oxides, hydroxides, carbonates, nitrates, borates, acetates, and the like.

A method comprising the steps of pulverizing raw compounds, mixing the powder of raw compounds, and sintering the powder mixture is usable for producing oxide-superconducting powder. Among the above methods, any of the methods wherein the raw compounds are pulverized together, and wherein a part of the raw compounds are mixed previously and the rest of the raw compounds are mixed later, is usable.

The temperature for heat treatment in synthesis and intermediate sintering of the superconductor powder is in a range of 700–1200° C. In a process of heating the superconductor at a temperature exceeding the temperature causing a partial melting and subsequent cooling, which is performed depending on necessity, non-superconducting phases are dispersed intra-grains of the superconducting phase, and a non-magnetic heat resistance alloy is utilized at an outermost layer to strengthen the structure.

Several methods of manufacturing an oxide-superconducting wire material have been disclosed. Hereinafter, a wire drawing-rolling method will be explained in detail as an example.

After the oxide-superconductor, or its precursor, is synthesized according to the method described above, the oxide-superconductor is pulverized to powder having an average particle size of 0.001–0.01 mm in diameter and is filled into a metallic tube. Then, a wire drawing process with 5–20% cross section reduction is performed using draw benches, swaggers, cassette roller dies, or grooved rolls. Subsequently, if necessary, multifilamentary formation of the wire material is performed. A method of multifilamentary formation comprises the steps of inserting the superconducting wire material, which is drawn in a shape having a circular cross section or a hexagonal cross section, into metallic tube, and drawing the metallic tube with 5–20% cross section reduction to a desired diameter using an apparatus such as explained above. The processes used hitherto have the effects of forming the wire material in a desired shape and increasing the density of the superconducting powder filled in the metallic sheath.

In order to increase the density further, the wire material is manufactured using a cold roller or a hot roller to form a tape shaped wire material having a flat cross section. Then, the tape shaped wire material is treated thermally at an adequate temperature in a suitable atmosphere to obtain a wire material having a high critical current density. The inventors of the present invention have confirmed by experiments that, in order to obtain a wire material having a further high critical current density, it is effective to roll the wire material so that the elongation in a longitudinal direction of the wire material is restricted to as small a value as possible, and the elongation in a lateral direction of the wire material is enhanced as much as possible. This is because densification of the superconducting core is enhanced. Depending on its usage, a wire material having a circular cross section itself may be used without performing the rolling.

As an adequate temperature for final heat treatment of the oxide-superconducting wire material, a temperature within a range of 700–1050° C. is used. The wire material is utilized in the form of a coil wound with a complex wire made up of at least two wires, or is formed in a shape of lead wires or a cable wire material, depending on its usage. In order to improve the characteristics of the superconductor by heat treatment, the atmosphere during heat treatment is selected depending on the kind of material. For instance, when a $Bi_2Sr_2Ca_1Cu_2O_x$ group superconductor is used, a low pressure oxygen atmosphere (for example, 1–20 vol. % $O_2$) is selected at the final heat treatment for obtaining high performance characteristics. However, in the case of a $Tl_2Ba_2Ca_2Cu_3O_x$ group superconductor, a pure oxygen atmosphere is selected, for example, because the higher the oxygen partial pressure is, the more the characteristics can be improved. In addition to the method explained above, an equivalent value can be obtained by using any wire materials manufactured by, for instance, a thermal spray method, a doctor-blade method, a dip-coat method, a screen print method, a spray pyrolysis method, a jelly roll method, and the like.

As material for the sheath and the substrate of the superconducting wire material, Ag, Au, Pd, Pt, a silver alloy containing 1–50 wt. % of Au, and Ag or a silver alloy containing 1–50 wt. % of Pd, Mg, Ti, Mn, Ni, and Cu, which do not necessitate considering any corrosion problem at the heat treatment, are mainly used. If necessary, a non magnetic heat resistant alloy is used at the outer most layer.

The insulating material which is wound with the oxide-superconducting wire material must be wound densely in view of coil design for obtaining generation of a high magnetic field. Therefore, the thickness of the insulating layer must be decreased desirably to 0.3 mm, and preferably to 0.1 mm, at the utmost. Naturally, the insulating material may not be allowed to deteriorate the superconducting characteristics after the heat treatment, but, additionally, it is important that the insulating material have as preferable insulating capability, a strong adhesiveness, a sufficient strength, and a preferable heat resistance.

In accordance with the present invention, a superconducting magnet, which generates a significantly strong magnetic field, can be realized by composing a structure with oxide-superconducting coils which are provided at the inner layer of a metallic group superconducting magnet. As the metallic group superconductor, any one of a NbTi group alloy, a $Nb_3Sn$ group alloy, a $Nb_3Al$ group alloy, a $V_3Ga$ group alloy, and a Chevrel group compound may be used, and, if necessary, at least two kinds of magnets are employed. The oxide-superconductor arranged at the inner layers is preferably one of the bismuth group superconductors. If the oxide-superconductor is a pan-cake shape coil and the characteristics of the respective coils vary somewhat, the high performance coils are arranged at a middle portion in a longitudinal direction of the coil, where the magnetic field is higher than that at both end portions. In accordance with this arrangement, a superconducting magnet capable of generating a strong magnetic field exceeding 18 T can be readily obtained.

The conductor manufactured to a desired structure by the method explained above is further fabricated in the form of a coil, current lead, cable, and the like, and a heat treatment is performed after winding. The superconducting wire material can be used for cables, current leads, an MRI (Magnetic Resonnance Imager) apparatus, a NMR (Nuclear Magnetic Resonnance) apparatus, a SMES (Superconducting Magnetic Energy Storage) apparatus, superconducting generators, superconducting motors, a magnetic levitation train, superconducting electromagnetic propulsion ships, superconducting transforms, and the like. The superconducting wire material is more advantageous if its operating temperature is higher than the temperature of liquid nitrogen.

In accordance with the method of the present invention for manufacturing an oxide-superconducting coil, the problem of the Jc characteristics being deteriorated by an electromagnetic force under a strong magnetic field, and the problem of deformation generated in a heat treatment process, other reactions, and the like can be solved. The heat resistant alloy used as the insulating material of the oxide-superconducting coil generally has a preferable workability. Accordingly, an advantage, in that a superconductor occupying volume fraction in a coil is readily increased in comparison with a tape shaped or fibrous ceramic insulating material, is realized The problem of the superconducting characteristics being deteriorated by components in the core of the superconducting wire material and components contained in the heat resistant alloy can be solved by manufacturing an oxide-superconducting coil wherein silver or a silver alloy is arranged at an intermediate layer of the heat resistant alloy, which is would together with the metallic sheathed superconducting wire material.

In view of the winding operation of a coil, especially a pan-cake shaped coil, the widths of the superconducting wire material, the silver or the silver alloy tape, and the heat resistant alloy desirably should coincide with each other within a range of 5%. For instance, if the width of the wire material is 5 mm, the other members desirably have a width in a range of 4.75 mm–5.25 mm.

Regarding the heat treatment of the coil, the inventors of the present invention have confirmed by experiments that fluctuation of the critical current density of the coil can be significantly suppressed by maintaining a temperature difference between a point at the inner plane and a point at the outer plane of the coil within 2° C. with a heater which is provided inside the core of the coil.

The problem of the reaction of the components in the superconducting core with the components contained in the heat resistant alloy can be solved by winding the coil after winding an insulating material, which contains silver or a silver alloy tape, a heat resistant alloy, or $Al_2O_3$ as a main component, in a spiral manner on the surface of the superconducting flat square wire material, or superconducting tape wire material.

Extending the alloy sheathed wire material in the order of kilometers became possible by manufacturing the alloy sheathed superconducting wire material, which was alloyed by a heat treatment, with an oxide-superconducting multifilamentary wire material coated with at least two different kinds of metals. In view of an application to a current lead and others, it is necessary to alloy the sheath material for making the material highly resistant. However, in a case when an Ag—Au alloy is used in a process for manufacturing the multifilamentary wire material by a powder in tube method, there has been a problem in that, if the Ag—Au alloy sheath is used from the step of the filling powder operation, the sheath material becomes hardened and a breakage of the wire material occurs during the processing. In consideration of the above problem, a long extension of the wire material became possible by using an Ag sheath for the sheath material to be filled with the powder and an Au sheath for the sheath material to be inserted with the Ag sheathed single core wire obtained by drawing the above powder filled Ag sheath, combining the above sheath materials so as to be a desired composition and proportion, and alloying the sheaths by a heat treatment.

Further, in a superconducting magnet system, wherein a complex superconducting magnet comprising a metallic superconducting magnet cooled with liquid helium and an oxide-superconducting coil generates a magnetic field exceeding 18 T, and an oxide superconducting current lead and a permanent current switch comprising an oxide-superconducting coil are provided thereto, it is advantageous if all the junctions are composed of superconducting connections. In the above case, decreasing the number of the junctions among the oxide-superconducting coils arranged in the inner layer of the superconducting magnet, the oxide-superconducting lead, and the permanent current switch as much as possible can reduce the connection resistance. Therefore, the above members are desirably composed of an integrated body.

In accordance with the above superconducting magnet system, loss of the liquid helium can be reduced, and a high efficiency can be realized. Either of a thermal switch to heat or a magnetic switch to add a magnetic field can be used as the above permanent current switch.

When winding a coil by a W & R method, wherein a heat treatment is performed after the winding, the superconducting characteristics may be deteriorated by a reaction of a superconducting wire material and an insulating material during the heat treatment, if a conventional ceramic unwoven cloth or fiber is used as the insulator the coil. The reason is that the conventional ceramic unwoven cloth or fiber contains about 50 wt. % $SiO_2$, which is acidic, and the insulator readily reacts with an alkali earth metal such as Sr, Ca, and the like in the superconducting wire material.

Therefore, the insulator used between each of the turns of the wire material is desirably a ceramic unwoven cloth or fiber containing at least a single kind of heat resistant oxide having an oxygen ion intensity ratio in a range of 0.5–2.5 by 90–100 wt. % content. The oxygen ion intensity ratio is an index of an intensity determined by the number of charges and the radius of the ion. Generally speaking, basic oxides having small oxygen ion intensity ratios, or acidic oxides having large oxygen ion intensity ratios, are inactive to each other, and a basic oxide and an acidic oxide are significantly reactive to each other. A reaction which practically occurs at the coil is assumed to react through a pin hole of the sheath, which may have been formed during the manufacturing process.

In accordance with the present invention, it is possible to manufacture an oxide-superconducting coil, which is prevented from experiencing deterioration of the Jc characteristics caused by an electromagnetic force in a strong magnetic field, and reactions and deformation at heat treatments, and can achieve 100% performance of wire elements even after being formed in the shape of a coil.

BRIEF DESCRIPTION OF THE DRAWINGS these and other objects, features and advantages of the present invention will be understood more clearly from the following detailed description when taken with reference to the accompanying drawings, wherein.

DESCRIPTION OF THE PREFERRED EMBODIMENTS

Figure 1:
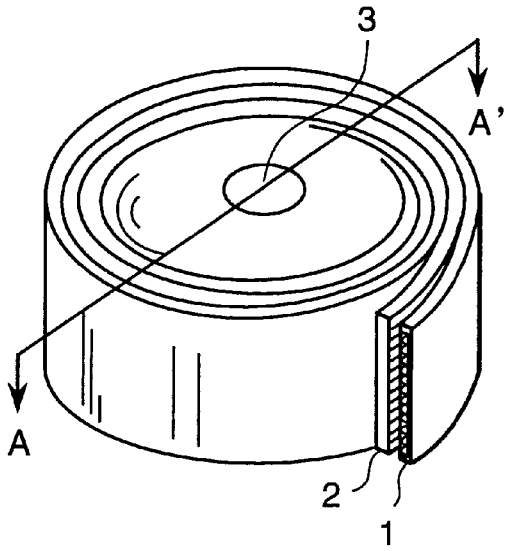
FIG. 1 is a schematic perspective illustration of an oxide-superconducting coil.

Hereinafter, an embodiment of the present invention will be explained with reference to the drawings.

Embodiment 1

Respective $Bi_2O_3$, SrO, CaO, and CuO oxides were used as a starting material and weighed so that the atomic mole ratio of Bi:Sr:Ca:Cu became 2.00:2.00:1.00:2.00. Then, a Bi-2212 superconducting powder was obtained by the steps of adding pure water to the weighed oxides, mixing the oxides by centrifugal ball milling for one hour, dehydrating and drying the mixture, and heat treating the dried mixture at 840° C. for 20 hours in a suitable atmosphere. As a result of observation by powder X-ray diffraction and a scanning electron microscope, other phases such as SrO, and CuO from a superconducting phase were somewhat observed.

The obtained powder was further pulverized by a grinder in an argon atmosphere to be, at the utmost, 0.01 mm in average diameter, and then, it was filled into an Ag tube of 6.0 mm in outer diameter and 5.0 mm in inner diameter. Subsequently, the Ag tube was drawn with a cross section reduction rate of 11–13% by a draw bench so as to be 1.03 mm in outer diameter. The Ag tube was cut into 19 equal length wires. After inserting the 19 wires into an Ag tube of 6.0 mm in outer diameter and 5.2 mm in inner diameter, the tube was cold drawn with a cross section reduction rate of 11–13% using a draw bench and a roller and finally a Bi-2212/19 multifilamentary tape-shaped Ag sheathed wire material 0.11–0.13 mm thick, 4.8–5.2 mm wide, and 50 m long was obtained. During above manufacturing operation of the single core and the multifilamentary wire material, an annealing treatment at 350° C. for 30 minutes was performed arbitrarily 1–3 times.

Figure 2:
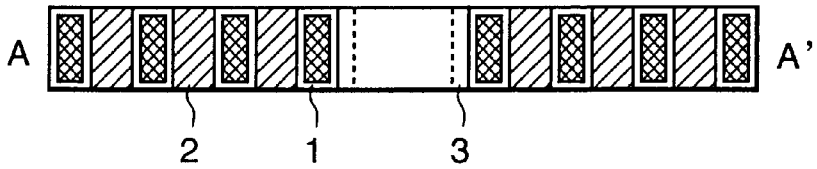
FIG. 2 is a schematic cross section of an oxide-superconducting coil taken on line A-A' in FIG. 1.

As shown in FIG. 1, the obtained Bi-2212 oxide superconducting wire material 1 and a hastelloy X tape 2, which was 0.03 mm thick and 5.1 mm wide, and which was previously heat treated at 800° C. to form an insulating film on its surface, were wound around an Ag ring 3 serving as a core, in a pancake shape while adding a tensile force of 10 $kgf/mm^2$ to the wire material 1 and of 20 $kgf/mm^2$ to the hastelloy X tape 2, respectively, to form a pancake coil 45 mm in outer diameter. A cross section of the coil taken on line A-A' in FIG. 1 is schematically shown in FIG. 2. The resistivity of the insulator was in the order of MΩs, and the insulation of the coil was sufficient.

The manufactured coil was heated to 880° C. for 4 hours in a pure oxygen atmosphere, kept at 880° C. for 10 minutes for a heat treatment of partial melting, cooled to 815° C. with a velocity of 0.25° C./minutes, and then, cooled to room temperature in 3 hours. Furthermore, in order to enhance the superconducting characteristics, an annealing treatment was performed at 800° C. for 20 hours in a low pressure oxygen atmosphere (4 vol. % $O_2$), and a Bi-2212 superconducting coil was obtained. In accordance with the above method, six pancake coils were manufactured. The six coils were piled on one another, and an adhesion treatment by diffusion joining at 800° C. for 10 hours was performed. At the joining portion, three Bi-2212 superconducting tape wires were used. After the heat treatment, a current of 10 A was supplied at room temperature. The generated magnetic field coincided with the design value. Accordingly, a short circuit between coils and between wire material did not exist. No change between the shapes of the coil before and after the heat treatment was observed, nor was any deformation by thermal distortion observed.

The critical current of short length (50 mm) wires, which were thermally treated simultaneously, in a zero magnetic field was determined by a four probe method for resistivity measurement at 20 K and 4.2 K. The results were 95 A at 20 K and 134 A at 4.2 K. In this case, the criterion for the critical current was 1 $\mu$V/cm.

The critical current of the coil in a zero external magnetic field was determined by a four probe method for resistivity measurement at 20 K and 4.2 K. The results were 82 A at 20 K, and 105 A at 4.2 K. The reason for the low characteristics of the coil is assumed to be due to the influence of a self induced magnetic field. In this case, the criterion for the critical current was $1\times10^{-13}$ Ω.m.

Then, the critical current of the coil in an external magnetic field of 21 T was determined by the four probe method for resistivity measurement at 4.2 K. Simultaneously, the magnetic field generated at the center of the coil was determined by using a Hall element. The result was 50 A at 4.2 K, and the generated magnetic field observed was 0.83 T. The values coincided with design values. The maximum electromagnetic force added to the oxide superconducting coil was 50 MPa.

After the measurement, the coil was examined visually. No deformation by the electromagnetic force or by the cooling was observed.

Embodiment 2

Six stacked bi-2212 superconducting coils were manufactured by the same method as the embodiment 1 except for replacing the insulating material of the pancake coil in the embodiment 1 with 97 wt. % $Al_2O_3$ containing insulating paper 0.1 mm thick and 5.05 mm wide.

The six coils were stacked on one another, and an adhesion treatment by diffusion joining at 800° C. for 10 hours was performed. At the joining portion, three Bi-2212 superconducting tape wire were used. No deformation of the coil shape was observed in a visual inspection of the coil after the heat treatment. By supplying a current of 10 A at room temperature, a magnetic field of 97% design value was generated.

The critical current of the coil in a zero external magnetic field was determined by a four probe method for resistivity measurement at 20 K and 4.2 K. The results were 81 A at 20 K, and 117 A at 4.2 K. In this case, the criterion for the critical current was $1\times10^{-13}$ Ω·m.

Then, the critical current of the coil in an external magnetic field of 21 T was determined by the four probe method for resistivity measurement at 4.2 K. Simultaneously, the magnetic field generated at the center of the coil was determined by using a Hall element. The result was 12 A at 4.2 K, and the gradient of the voltage rise in a V-I curve was moderate.

In a visual inspection of the coil after the measurement, an apparent deformation by the electromagnetic force was observed.

Embodiment 3

Bi-2212 superconducting powder obtained by the same method as the embodiment 1 was filled into an Ag tube 6.0 mm in outer diameter and 5.0 mm in inner diameter. Subsequently, the Ag tube was drawn with a cross section reduction rate of 11~13% using a draw bench, and finally was drawn with a hexagonal die, of which the longest diameter was 0.96 mm. The obtained wire was cut into 55 equal length wires. After inserting the 55 wires and six Ag wires 0.5 mm in outer diameter into an Ag tube 8.3 mm in outer diameter and 7.2 mm in inner diameter, the tube was cold drawn with a cross section reduction rate of 11~13% using a draw bench and a roller, and finally a Bi-2212/55 multifilamentary tape-shaped Ag sheathed wire material 0.11~0.13 mm thick, 4.8~5.2 mm wide, and 50 m long was obtained. During the above manufacturing operation of the single core and the multifilamentary wire material, an annealing treatment at 350° C. for 30 minutes was performed arbitrarily 1~3 times.

Twelve pancake coils of 100 mm in outer diameter as shown in FIG. 1 were manufactured by the same method as the embodiment 1 using the obtained Bi-2212 oxide superconducting wire material 1 and a Haynes alloy (No. 230) tape, i.e. a heat resistant alloy 2, 0.03 mm thick and 5.2 mm wide, which was previously heat treated at 800° C. to form an insulating film on its surface. The resistivity of the insulator was in the order of MΩs, and the insulation of the coil was sufficient.

After manufacturing twelve coils, the coils were divided into six pairs, two coils each. Two coils in a pair were connected inside the core 3 using three Bi-2212 oxide-superconducting wires for the connection 4 to form a double stacked pancake coil, respectively. Subsequently, the six double stacked pancake coils were stacked and an adhesion treatment for the outer portion of the coils was performed by diffusion joining at 800° C. for 10 hours.

Figure 3:
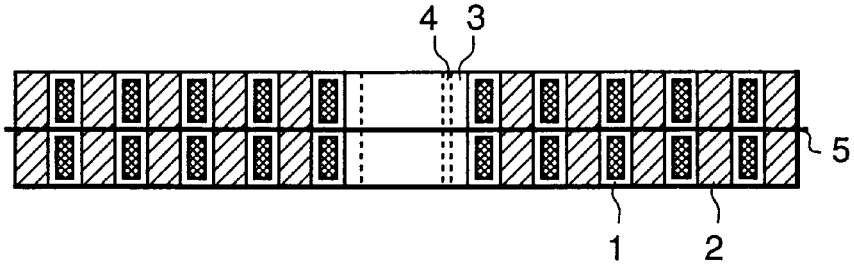
FIG. 3 is a schematic cross section of a single pancake coil wherein a reinforcer is interposed.

In the present embodiment, a SUS 310 strip 5 0.1 mm thick, i.e. a heat resistant alloy 5 having an oxide film formed on its surface, was interposed between respective coils as shown in FIG. 3, and then a heat treatment was performed. After the final heat treatment, a current of 10 A was supplied at room temperature. The generated magnetic field coincided with the design value. Accordingly, it could be assumed that a short circuit between coils and between wire material did not exist. No change between the shapes of the coil before and after the heat treatment was observed, nor was any deformation by thermal distortion observed. Accordingly, it was revealed that the total load of the coil was supported by the core and the SUS strip.

The critical current of short length (50 mm) wires, which were thermally treated simultaneously, in a zero magnetic field was determined by a four probe method for resistivity measurement at 4.2 K. The result was 122 A at 4.2 K. In this case, the criterion for the critical current was 1 $\mu$V/cm.

Further, the critical current of the coil in a zero external magnetic field was determined by a four probe method for resistivity measurement at 4.2 K. The result was 96 A at 4.2 K. In this case, the criterion for the critical current was $1\times10^{-13}$ Ω·m.

Then, the critical current of the coil in an external magnetic field of 18 T was determined by the four probe method for resistivity measurement at 4.2 K. Simultaneously, the magnetic field generated at the center of the coil was determined by using a Hall element. The result was 44 A at 4.2 K, and the generated magnetic field observed was 2.2 T. The value coincided with the design value. The maximum electromagnetic force added to the oxide-superconducting coil was 43 MPa.

After the measurement, the coil was examined visually. No deformation by the electromagnetic force or by the cooling was observed.

Embodiment 4

Twelve stacked Bi-2212 superconducting coils were manufactured by the same method as the embodiment 2 except for replacing the insulating material in the pancake coil of the embodiment 3 with ceramics insulating tape (70 wt. % $Al_2O_3$ - 30 wt % $SiO_2$) 0.1 mm thick and 5.05 mm wide, and using no SUS strip between the coils.

The twelve coils, i.e. six pairs, two coils each, were stacked, and an adhesion treatment was performed by diffusion joining at 800° C.10 hours. Three Bi2212 superconducting tape wires were used at the joining portion. As a result of visual inspection of the coil after the heat treatment, a slight creep deformation caused by the coil's own weight was observed. A tendency was observed that the deformation became larger at the outer position of the coil than at the inner position of the coil. In comparison with the embodiment 3, it was revealed that the weight of the coil itself could not be supported because use of the heat resistant alloy was omitted.

The critical current of the coil was determined by supplying a current of 10 A at room temperature, and generation of only 60% of the design magnetic field was observed. The reason was assumed to be a short circuit caused by deformation of the coil accompanied by a sealing up of the coil. A result of a visual inspection of the wire material after disassembling the coil from a terminal end at the outer portion revealed that a short circuit was generated at the outer portion of the coil, where the deformation during the heat treatment was large.

Embodiment 5

Figure 4:
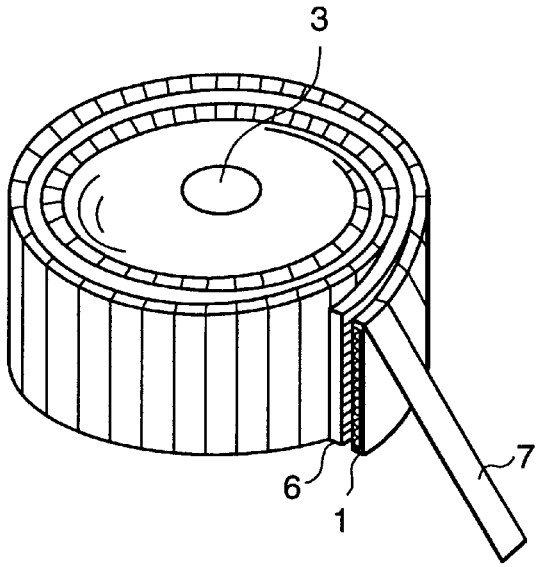
FIG. 4 is a schematic perspective illustration of an oxide-superconducting coil.
Figure 5:
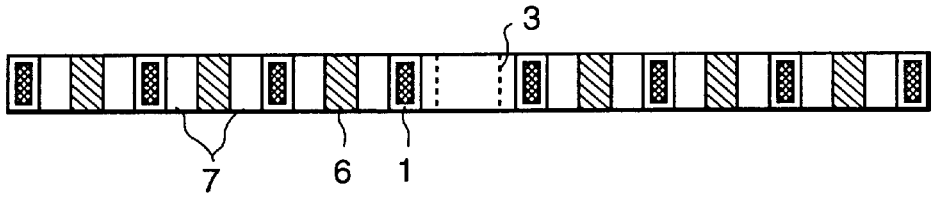
FIG. 5 is a schematic cross section of an oxide-superconducting coil.

A pancake coil was manufactured as shown in FIG. 4, wherein an Ag-0.2 wt. % Mg alloy tape 7 0.04 mm thick and 5.0 mm wide was interposed at an intermediate layer between a Bi-2212/19 multifilamentary tape shaped Ag sheathed wire obtained by the same method as the embodiment 1 and a hastelloy X tape 0.03 mm thick and 5 mm wide, i.e. a heat resistant alloy 6 whereon no oxide film was formed. In accordance with the present embodiment, the Ag-0.2 wt. % Mg alloy tape 7 was wound on the surface of the Bi-2212 wire material 1 in a spiral manner, and further, the hastelloy X tape, i.e. a heat resistant alloy 6 whereon no oxide film was formed, was wound together therewith. A schematic cross section of the coil is shown in FIG. 5.

The obtained pancake coil was thermally treated in the same manner as the embodiment 1, and a Bi-2212 superconducting coil 80 mm in outer diameter was manufactured. After manufacturing 10 coils in the same manner, the coils were stacked to form a 10 stage coil. Between respective ones of the coils, a Haynes alloy plate 4 of 0.1 mm thickness was interposed between coils. The shapes of the coils before and after the heat treatment did not show any change similar to the embodiment 1. A current of 10 A was supplied to the coil at room temperature, and a coincident magnetic field at the design value was generated. Accordingly, no short circuit was recognized.

The critical current of short length (50 mm) wires, which were thermally treated simultaneously, in a zero magnetic field was determined by a four probe method for resistivity measurement at 20 K and 4.2 K. The results were 116 A at 20 K and 157 A at 4.2 K. In this case, the criterion for the critical current was 1 $\mu$V/cm.

Further, the critical current of the coil in a zero external magnetic field was determined by a four probe method for resistivity measurement at 20 K and 4.2 K. The results were 94 A at 20 K and 134 A at 4.2 K. In this case, the criterion for the critical current was $1\times10^{-13}$ Ω·m.

Then, the critical current of the coil in external magnetic fields of 18 T and 21 T was determined by the four probe method for resistivity measurement at 4.2 K. Simultaneously, the magnetic fields generated at the center of the coil were determined by using a Hall element. As for the results, the critical current at 18 T was 73 A, and at 21 T it was 70 A. The generated magnetic fields were 2.02 T and 1.94 T, respectively. The values coincided with the design values. The maximum electromagnetic force added to the oxide-superconducting coil was 45~55 MPa.

After the measurement, the coil was inspected visually, and no deformation was observed.

In the present embodiment, the heat resistant alloy tape, whereon no oxide film was formed, was used for insulating the coil. However, the same result can be naturally obtained if a heat resistant alloy tape, whereon an oxide film is formed, is used.

Embodiment 6

A pancake coil was manufactured by the same method as the embodiment 3 except no Ag-0.2 wt. % Mg alloy tape was used at the intermediate layer of the pancake coil as in the embodiment 5. Subsequently, the same heat treatment as the embodiment 1 was performed to obtain a Bi-2212 superconducting coil.

The critical current of the coil in zero external magnetic fields was determined by a four probe method for resistivity measurement at 20 K and 4.2 K. The results were 61 A at 20 K and 75 A at 4.2 K. In this case, the criterion for the critical current was $1\times10^{-13}$ Ω·m.

A result of a visual inspection of the wire material after disassembling the coil from a terminal end at the outer portion revealed that a reaction had occurred between the superconducting wire material and the Hastelloy X tape. The reason for this can be supposed to be that the Hastelloy X tape absorbed oxygen from the superconductor when the oxide film was formed on the surface of the Hastelloy x tape by the heat treatment.

Embodiment 7

Respective $Bi_2O_3$, PbO, SrO, CaO, and CuO oxides were used as a starting material and were weighed so that the atomic mole ratio of Bi:Pb:Sr:Ca:Cu became 1.74:0.34:2.00:2.20:3.00. Then, a Bi-2223 superconducting precursor was obtained by the steps of adding ethyl alcohol to the weighed oxides, mixing the oxides by centrifugal ball milling for one hour, dehydrating and drying the mixture, and heat treating the dried mixture at 790° C. for 20 hours in the atmosphere. As a result of observation by powder X-ray diffraction and a scanning electron microscope, a main component of the obtained powder was revealed to be Bi-2212 phase. Additionally, another substance containing Sr-Ca-Cu-O, which could not be determined, and SrO, CuO, $Ca_2$ $PbO_4$, and the like were detected.

The obtained powder was further pulverized by a grinder to be, at the utmost, 0.01 mm in average diameter, and then, it was filled into an Ag tube 6.0 mm in outer diameter and 4.5 mm in inner diameter.

The tube was manufactured in the same manner as in the embodiment 1, and finally a Bi-2223/19 multifilamentary tape-shaped Ag sheathed wire 0.5 mm thick, 2.6 mm wide, and 30 m long was obtained.

The wire material was wound around a drum made of SUS having an outer diameter of 50 cm, and a heat treatment was performed at 838° C. for 50 hours in an atmosphere using a large scale electric furnace. During the heat treatment, the temperature distribution was controlled to be within 2° C. After the heat treatment, the wire material was drawn to be 0.3 mm thick, and again a heat treatment at 838° C. for 50 hours was performed. Similarly the steps of drawing the wire material to 0.2 mm in thickness performing the heat treatment, and drawing the wire material again to be 0.11~0.13 mm thick were performed. The width of the wire material was in a range of 4.8~5.2 mm.

Figure 6:
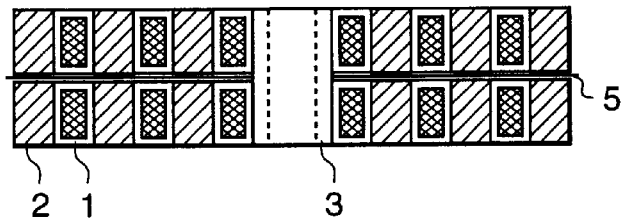
FIG. 6 is a schematic cross section of a double pancake coil wherein a reinforcer is inserted.

A double pancake coil as shown in FIG. 4 was manufactured using the obtained Bi-2223 oxide superconducting wire material 1 and a Haynes alloy (No. 230) 2 which was 0.05 mm thick and 5.1 mm wide, i.e. a heat resistant alloy 2 which was previously treated thermally at 650° C. for 5 hours in an oxygen atmosphere to form an oxide film on its surface. A tensile force of 5 kgf/mm$^2$ was added to the oxide superconducting wire material 1 and a tensile force of 40 kgf/mm$^2$ was added to the Haynes alloy (No. 230) tape in the winding operation to form a double pancake coil 80 mm in outer diameter and 10.5 mm wide. In the present embodiment, a SUS 310 core 30 mm in outer diameter and 10.5 mm high was used as the coil core 3. A hastelloy strip as shown in FIG. 6, i.e. a heat resistant alloy 5 whereon an oxide film was formed, was interposed at the middle in the longitudinal direction of the double pancake coil. The oxide film on the surface of the hastelloy was previously formed.

The manufactured coil was treated by heating at 835° C. for 50 hours in a 20 vol. % $O_2$ atmosphere, and a Bi-2223 superconducting coil was obtained. The appearance of the obtained coil after the heat treatment indicated no change in comparison with the appearance before the heat treatment. A current was supplied to the coil at room temperature, and the generated magnetic field coincided with the design value. Accordingly, a short circuit between coils and between wire material was not recognized.

The critical current of short length (50 mm) wires, which were thermally treated simultaneously, in a zero magnetic field were determined by a four probe method for resistivity measurement at 77 K and 63 K. The results were 14 A at 77 K and 27 A at 63 K. In this case, the criterion for the critical current was 1 $\mu$V/cm.

The critical current of the coil in a zero external magnetic field was determined by a four probe method for resistivity measurement at 77 K and 63 K. The results were 10 A at 77 K and 22 A at 63 K. In this case, the criterion for the critical current was $1\times10^{-13}$ Ω·m.

The reason why the characteristics of the coil were lower than that of the short length wire material is assumed to be due to the influence of a self induced magnetic field of the coil.

When any one of Ag, hastelloy X, and Haynes alloy (No. 230) was used as the material for the coil core, the same value in the characteristics of the coil was obtained.

Embodiment 8

A single pancake coil as shown in FIG. 1 was manufactured using the Bi-2223/19 multifilamentary tape shaped Ag sheathed wire material 1 obtained by the same method as the embodiment 7 and a Haynes alloy (No. 230) 2. An Ag ring was used as the coil core 3. The shape of the coil was 80 mm in outer diameter and 30 mm in inner diameter. A voltage terminal was inserted at every 1 meter of the wire material during the winding operation.

The manufactured coil was thermally treated at 835° C. for 50 hours in a 20 vol. % $O_2$ atmosphere, and a Bi-2223 superconducting coil was obtained. At the heat treatment, a heater was provided at the inner portion of the coil core, and the temperature was controlled so that the temperature difference between the outer portion of the coil and the inner portion of the coil was within 1° C. The obtained coil indicated no change in the shape before and after the heat treatment, nor any thermal distortion.

The critical current between terminal ends of the coil in a zero magnetic field was determined by a four probe method for resistivity measurement at 77 K and 4.2 K. The results were 15 A at 77 K and 55 A at 4.2 K. In this case, the criterion for the critical current was $1\times10^{-13}$ Ω·m.

Then, the critical current between the voltage terminals inserted at every 1 meter of the wire material in a zero magnetic field was determined at 4.2 K for investigating a distribution of the critical current. As a result, it was revealed that the critical current of the coil was distributed to within 4%.

The appearance of the coil was visually inspected after the heat treatment, and no deformation was observed.

Figure 7:
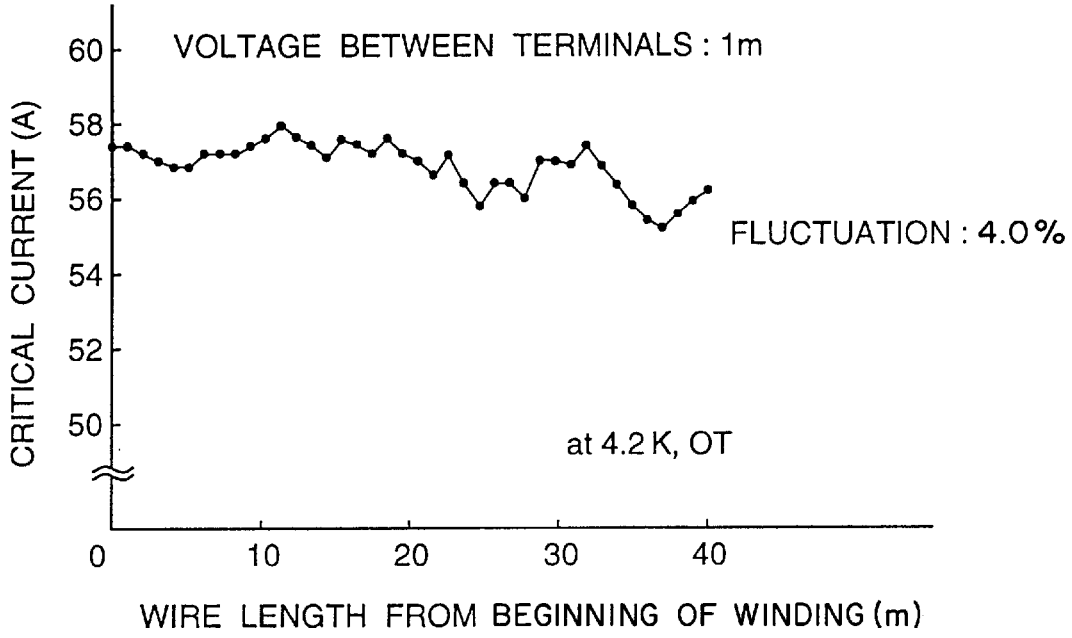
FIG. 7 is a graph indicating a critical current distribution in a coil wherein a heater is provided inside the core of the coil.

The distribution of the critical current of the coil is summarized in FIG. 7.

Embodiment 9

Bi-2223 double pancake coils were manufactured in the same manner as the embodiment 8 except that no heater was provided at the inner portion of the coil core in the heat treatment of the superconducting coil as in the embodiment 8.

The critical current between terminal ends of the coil in a zero magnetic field was determined by a four probe method for resistivity measurement at 77 K and 4.2 K. The results were 13 A at 77 K and 50 A at 4.2 K.

Then, the critical current between the voltage terminals inserted at every 1 meter of the wire material in a zero magnetic field was determined at 4.2 K for investigating a distribution of the critical current. As a result, it was revealed that the critical current of the coil was distributed as wide as 20%.

The appearance of the coil was visually inspected after the heat treatment, and no deformation was observed.

Figure 8:
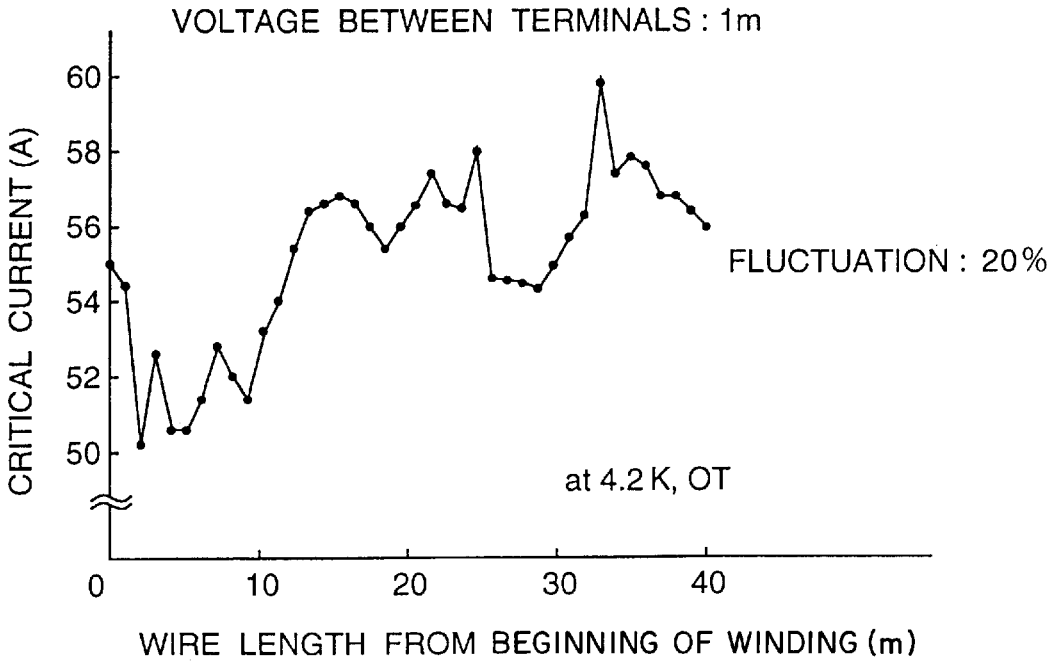
FIG. 8 is a graph indicating a critical current distribution in a coil manufactured by a conventional heat treating furnace.

The distribution of the critical current of the coil is summarized in FIG. 8.

Embodiment 10

Bi-2223 precursor obtained by the same method as the embodiment 7 was filled into an Ag tube 6.0 mm in outer diameter and 4.0 mm in inner diameter. Subsequently, the Ag tube was drawn with a cross section reduction rate of 11~13% by a draw bench, and finally a wire drawn to 1.03 mm in outer diameter. The obtained wire was cut into 19 equal length wires. After inserting the 19 wires into an Au tube 6.0 mm in outer diameter and 5.75 mm in inner diameter, the tube was processed repeatedly by drawing and heat treatment, and finally a Bi-2223/19 multifilamentary Ag-Au alloy sheathed wire material 0.11~0.13 mm thick, 4.8~5.2 mm wide, and 90~100 m long was obtained. The alloy sheath composition after the heat treatment was Ag-17 wt. % Au. The core ratio of the wire material was 20%.

Embodiment 11

Bi-2223 precursor obtained by the same method as the embodiment 7 was filled into an Ag-17 wt. % Au alloy tube of 6.0 mm in outer diameter in a 19 cores condition with a core ratio of 20%, and subsequently, the alloy tube was drawn with a cross section reduction rate of 11~13% by a draw bench. However, breakage of the wire material occurred very often during the manufacturing of the single core wire, and no wire material of more than 5 meters could be obtained.

Embodiment 12

Figure 9:
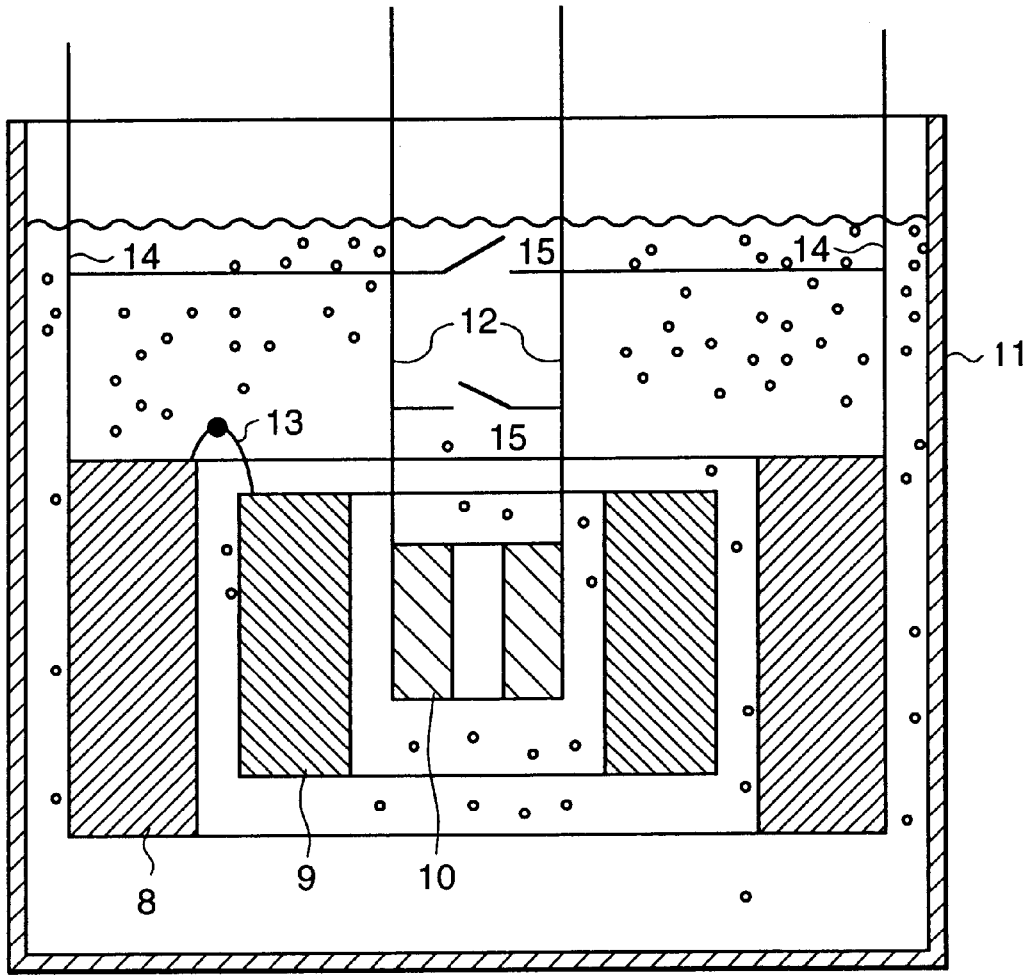
FIG. 9 is a schematic cross section of a superconducting magnet system.

A complex superconducting magnet was manufactured, where a Bi-2212 group oxide superconducting coil 10 was arranged inside a NbTi superconducting magnet 8 and a $Nb_3Sn$ superconducting magnet 9, which were cooled by liquid helium, as shown in FIG. 9. Briefly speaking, the structure of the magnet shown in FIG. 9 was composed of the $Nb_3Sn$ superconducting magnet 9 wound as a concentric circle and arranged at the inside of the NbTi superconducting magnet 8 wound as a concentric circle, and further, the Bi-2212 group oxide superconducting coil 10 wound as a concentric circle was arranged at the inside of the $Nb_3Sn$ superconducting magnet 9 wound as a concentric circle. The heights of the magnets were designated so that the inner magnet had a lower height than that of the outer magnet. All of those were solenoid wound magnets.

The superconducting coils were fixed in a cryostat 11, and a control current was supplied through a current lead from an external power source. A hastelloy X tape formed with an insulating film thereon as explained for the embodiment 1 was used for the insulation between the coils of the Bi group oxide superconducting coil 10. At both ends of the Bi group oxide superconducting coil 10, a current lead 12 composed of Bi-2223 was connected superconducting by diffusion welding. The one end of the respective NbTi superconducting magnet 8 and the $Nb_3Sn$ superconducting magnet 9 were connected mutually in a normal conducting condition 13 by soldering, and current to the magnets was supplied through copper leads 14.

In order to make it possible to operate a permanent current mode, a permanent current switch 15 composed of a Bi-2212 group superconducting coil was installed. The permanent current switch 15 was connected superconductingly with a current lead.

The complex superconducting magnet generated a magnetic field of 23.5 T, and no problem was experienced during continuous operation for three months. By using the oxide superconductor for the permanent current switch as explained above, the stability increased because the temperature margin was higher than that of a conventional metallic group superconductor, and generation of a quench was prevented. Furthermore, a decrease in the running cost was realized.

In accordance with the present invention, a deformation of the coil by its own weight during the heat treatment can be prevented by using a heat resistant metal, whereon an oxide film is formed, as an insulator for an oxide superconducting coil manufactured by a W & R method. Furthermore, by arranging silver or a silver alloy at an intermediate layer between the oxide superconducting wire material and a co-winding heat resistant alloy, a problem of reaction during the heat treatment can be solved. The above members have a sufficient mechanical strength against an electromagnetic force under a strong magnetic field, and accordingly, a magnet applicable to use in a strong magnetic field using the oxide superconducting coil can be realized.

What is claimed is:

1. An oxide superconducting coil, comprising:

a metal sheathed oxide superconducting wire material, and a heat resistant alloy having an oxide film on its surface co-wound into a coil with said metal sheathed oxide superconducting wire material, wherein said oxide film prevents reaction of components of said metal sheathed oxide superconducting wire material with components of said heat resistant alloy and is previously formed on said surface of said heat resistant alloy by a first heat treatment prior to being co-wound with said metal sheathed oxide superconducting wire material, and said oxide superconducting coil is processed by a second heat treatment to provide superconducting characteristics to the coil after said metal sheathed oxide superconducting wire material and said heat resistant alloy are co-wound.

2. An oxide superconducting coil as claimed in claim 1, wherein said first and said second heat treatments are performed at a temperature in a range of about 700~1050° C. for a time in a range of about 1~100 hours.

3. An oxide superconducting coil, comprising:

a metal sheathed oxide superconducting wire material, and a heat resistant alloy having an oxide film on its surface co-wound with said metal sheathed oxide superconducting wire material, wherein said oxide film prevents reaction of components of said metal sheathed oxide superconducting wire material with components of said heat resistant alloy and is previously formed on said surface of said heat resistant alloy by a first heat treatment prior to being co-wound with said metal sheathed oxide superconducting wire material.

4. An oxide superconducting coil according to claim 3, wherein a layer composed of silver or a silver alloy is arranged at an intermediate portion between said metal sheathed oxide superconducting wire material and said heat resistant alloy.

5. An oxide superconducting coil according to claim 3, wherein said metal sheathed oxide superconducting wire material is wound with a silver tape or a silver alloy tape in a spiral manner.

6. An oxide superconducting coil as claimed in claim 4, wherein said heat resistant alloy contains at least one element selected from a group consisting of Ni, Cr, Cu, Nb, Mn, Co, Fe, Al, Mo, Ta, W, Be, and Sn.

7. An oxide superconducting coil as claimed in claim 3, wherein the width of said oxide superconducting wire material, the width of tapes made of silver or a silver alloy, and the width of said heat resistant alloy coincide within a tolerance range of 5%.

8. An oxide superconducting coil according to claim 3, wherein said metal sheathed oxide superconducting wire material is an oxide superconducting multifilamentary wire material coated with two kinds of metals and alloyed.

9. A method of manufacturing an oxide superconducting coil, comprising the steps of:

performing a first heat treatment of a heat resistant alloy to form an oxide film on its surface, co-winding said heat resistant alloy having the oxide film formed on its surface and a metal sheathed oxide superconducting wire material in a pancake manner, or a solenoid manner, into a coil around a bobbin, and performing a second heat treatment of the coil to provide superconducting characteristics to the coil, wherein said oxide film prevents reaction of components of said metal sheathed oxide superconducting wire material with components of said heat resistant alloy.

10. A method of manufacturing an oxide superconducting coil according to claim 9, wherein said first and said second heat treatments are performed at a temperature in a range of about 700–1050° C. for a time in a range of about 1–100 hours.

11. A method of manufacturing an oxide superconducting coil according to claim 9, wherein a temperature difference between the inside and outside of the coil is maintained within a range of 2° C. during said second heat treatment.

12. A method of manufacturing an oxide superconducting coil according to claim 9, wherein a layer composed of silver or a silver alloy is co-wound with said metal sheathed oxide superconducting wire material and said heat resistant alloy and arranged at an intermediate portion between said metal sheathed oxide superconducting wire material and said heat resistant alloy.

13. A method of manufacturing an oxide superconducting coil according to claim 9, wherein said metal sheathed oxide superconducting wire material is wound with a silver tape or a silver alloy tape in a spiral manner.

14. A superconducting magnet system, comprising:

a metal group superconducting magnet;

an oxide superconducting current lead for supplying a current from a power source to said magnet; and a persistent current switch for performing on-off operations of an oxide superconducting coil claimed in claim 3, all of which are cooled by liquid helium, wherein all joints among said magnet, said current lead and said persistent current switch are in a superconducting condition.

15. An oxide superconducting coil according to claim 3, wherein said coil has a cross-sectional structure having, in a direction from a center of the coil to a periphery of the coil, a plurality of repeating winding units, each repeating winding unit comprising, in a radial direction, a metal sheath layer, an oxide superconducting wire material layer, a metal sheath layer, an oxide film layer, a heat resistant alloy layer, and an oxide film layer.

16. An oxide superconducting coil according to claim 5, wherein said coil has a cross-sectional structure having, in a direction from a center of the coil to a periphery of the coil, a plurality of repeating winding units, each repeating winding unit comprising, in a radial direction, a silver or silver alloy tape layer, a metal sheath layer, an oxide superconducting wire material layer, a metal sheath layer, a silver or silver alloy tape layer, an oxide film layer, a heat resistant alloy layer, and an oxide film layer.

* * * * *